US007617675B2

(12) United States Patent
Kellermann

(10) Patent No.: US 7,617,675 B2
(45) Date of Patent: Nov. 17, 2009

(54) CATALYST CHAMBER

(75) Inventor: Christian Kellermann, Stapelfeld (DE)

(73) Assignee: DOLMAR, GmbH, Hamburg (DE)

( * ) Notice: Subject to any disclaimer, the term of this patent is extended or adjusted under 35 U.S.C. 154(b) by 360 days.

(21) Appl. No.: 11/466,020

(22) Filed: Aug. 21, 2006

(65) Prior Publication Data

US 2008/0110160 A1 May 15, 2008

(30) Foreign Application Priority Data

Aug. 31, 2005 (DE) ..... 20 2005 013 804 U

(51) Int. Cl.
*F01N 3/10* (2006.01)

(52) U.S. Cl. ..... 60/299; 60/272; 60/302; 60/308; 60/312; 60/322; 181/240; 181/255; 181/264; 181/272

(58) Field of Classification Search ..... 60/272, 60/289, 299, 301, 302, 308, 312, 322, 324; 181/240, 251, 255, 264, 266, 269, 272, 282
See application file for complete search history.

(56) References Cited

U.S. PATENT DOCUMENTS

| | | | | |
|---|---|---|---|---|
| 4,235,843 | A * | 11/1980 | Tadokoro et al. | 422/119 |
| 4,237,099 | A | 12/1980 | Alley et al. | |
| 4,265,332 | A | 5/1981 | Presnall et al. | |
| 4,741,411 | A | 5/1988 | Stricker | |
| 4,894,987 | A * | 1/1990 | Harwood et al. | 60/299 |
| 5,218,817 | A * | 6/1993 | Urata | 60/274 |
| 5,736,690 | A * | 4/1998 | Karlsson | 181/230 |
| 7,032,709 | B2 * | 4/2006 | Hoche et al. | 181/268 |
| 7,296,657 | B2 * | 11/2007 | Ohno et al. | 181/272 |

FOREIGN PATENT DOCUMENTS

| | | | |
|---|---|---|---|
| CN | 1272903 | A | 11/2000 |
| DE | 3013691 | A1 | 11/1980 |
| DE | 3829668 | A1 | 6/1989 |
| DE | 100 42 145 | A1 | 3/2002 |
| DE | 101 39 700 | A1 | 4/2002 |
| EP | 0 785 342 | A1 | 7/1997 |
| EP | 0785342 | A1 | 7/1997 |

* cited by examiner

*Primary Examiner*—Binh Q. Tran
(74) *Attorney, Agent, or Firm*—Kelly Lowry & Kelley, LLP

(57) ABSTRACT

In order to make available an exhaust gas system for a combustion engine with an external housing, which contains at least one rear shell and one front shell, and with a catalyst chamber, in which at least one catalyst element is arranged, and with an exhaust gas duct, from which exhaust gas is conveyed from the catalyst chamber, said exhaust gas system including few components and being able to be produced cost-effectively and wherein harmful thermal stresses in the components of the exhaust gas system are largely avoided, the catalyst chamber also forms the exhaust gas duct. The catalyst chamber has at least two chamber halves, and the exhaust gas duct is provided materially uniform and in one piece in at least one chamber half.

19 Claims, 3 Drawing Sheets

CATALYST CHAMBER

DESCRIPTION

Figure 1:
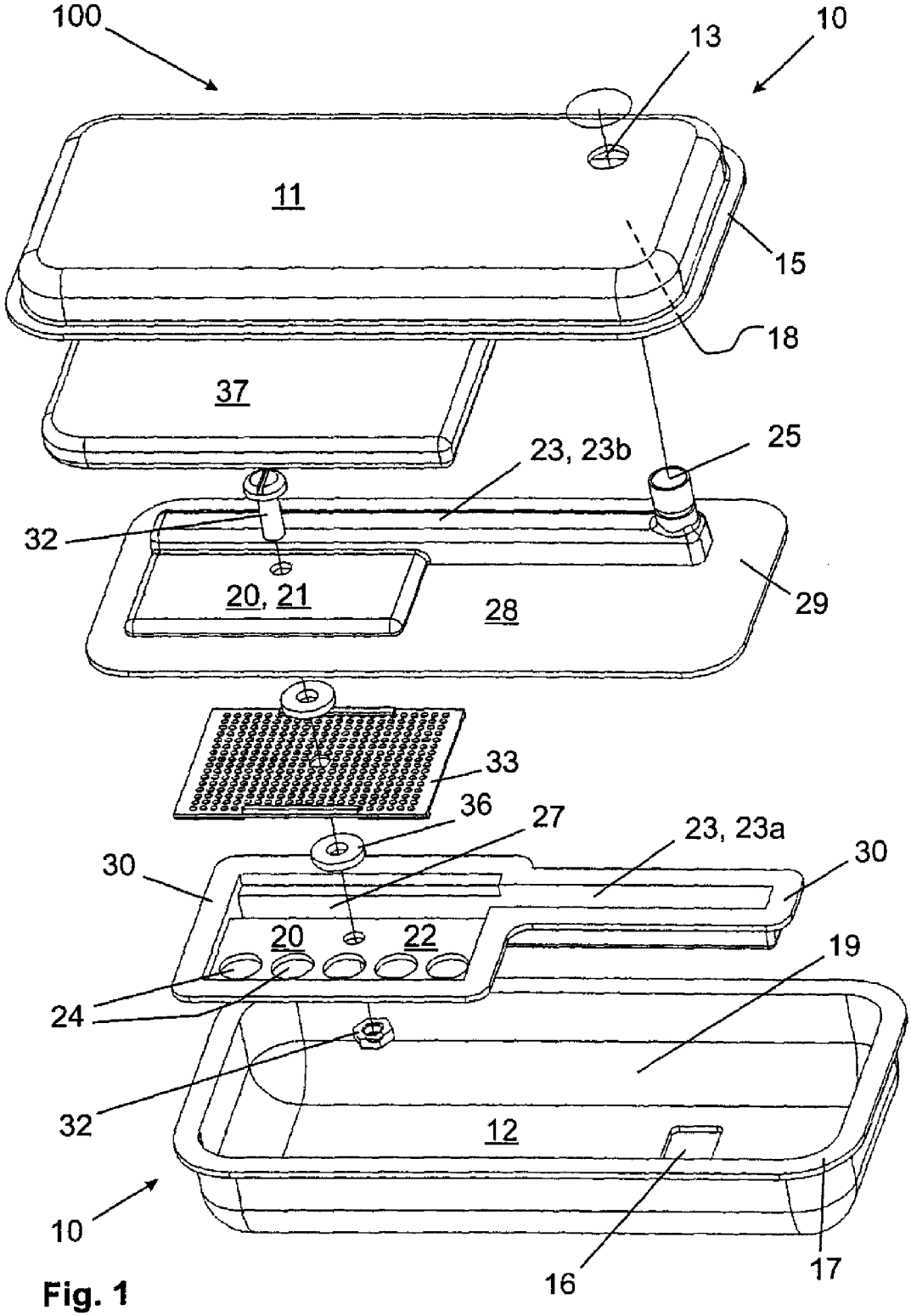

The invention relates to an exhaust gas system for a combustion engine with at least one catalyst element for the conversion of combustion exhaust gases. This exhaust gas system can be used for a four-stroke or a two-stroke petrol engine. Since the exhaust gas system itself has a particularly compact design, it can also be used for manually operated machine tools, such as for example petrol operated cut-off grinders, chainsaws, hedge clippers or suchlike. Generic exhaust gas systems comprise an external housing, which contains at least one rear shell and one front shell. Furthermore, these exhaust gas systems are equipped with a catalyst chamber, in which at least one catalyst element is arranged, and with an exhaust gas duct, from which exhaust gas is conveyed out of the catalyst chamber.

It is known from the prior art to equip exhaust gas systems with catalyst elements in order to reduce the harmful emission from combustion engines. The use of the catalyst elements enables a post-treatment of the exhaust gas with the components contained in the exhaust gas. For example, the hydrocarbons present are converted with the aid of the residual oxygen content into carbon dioxide or carbon monoxide and water. However, heat is liberated in this chemical cleaning process or conversion process, as a result of which the exhaust gases from the combustion engine, which are anyway already hot, are further heated. Considerable heat is thus liberated by the conversion of the hydrocarbons, as a result of which conventional catalysts with a honeycomb design may be destroyed, especially in the case of two-stroke engines with high hydrocarbon emissions. For this reason, use is readily made of catalysts in the form of coated metal sheets, stretch grids or wire fabrics, which have proved to be sufficiently resistant, and which undergo less thermal loading due to their small overall depth. In order to prevent the whole external housing of the exhaust air system from coming into contact with hot converted exhaust gases, so-called catalyst chambers are used for the catalysts, from which catalyst chambers the cleaned exhaust gases are then conveyed through an adjacent exhaust gas duct directly or indirectly from the external housing to the exterior. The effect of this measure is that the thermal load on the housing material is reduced, although a catalyst element is used.

The use of such catalyst chambers in exhaust gas systems is known, amongst others, from publication DE 38 29 668 A1. In the case of the exhaust gas system disclosed there, use is made of a catalyst chamber which comprises a large opening, through which the as yet untreated exhaust gases are introduced. The introduced exhaust gases first flow through the catalyst element and then passes into the exhaust gas duct. Here, the catalyst chamber is structurally separate from the exhaust gas duct and is held together solely by means of a plug-in connection or a weld joint. A large number of parts (sheet metal parts) are therefore used in order to form the catalyst chamber and the following exhaust gas duct. On the one hand, this is costly from the production standpoint and is reflected in production costs, and on the other hand different temperature expansions arise due to the use of different parts, as a result of which high thermal stresses are easily produced in the components.

Against this background, therefore, the problem underlying the invention is to make available an exhaust gas system with a catalyst chamber which comprises fewer individual parts and can be produced cost-effectively. Furthermore, harmful thermal stresses in the components of the exhaust gas system are to be largely avoided.

According to the invention, this problem is solved by the measures stated in the characterising part of claim 1.

According to the invention, the exhaust gas system for a combustion engine comprises an external housing, which contains at least one rear shell and one front shell. In order that the combustion exhaust gas from the engine does not get into the environment uncleaned, a catalyst element is also provided in the exhaust gas system, said catalyst element being arranged in a catalyst chamber. It goes without saying that a second catalyst chamber with a catalyst element can also be arranged inside the exhaust gas system, which can be connected either in parallel or in series with the first catalyst chamber. An exhaust gas duct is provided in order that the exhaust gas can escape from the catalyst chamber, whereby the catalyst chamber simultaneously or additionally forms the exhaust gas duct. The catalyst chamber contains at least two chamber halves, whereby the exhaust gas duct is provided materially uniform and in one piece in at least one chamber half. The exhaust gas duct is therefore formed by at least one chamber half. The exhaust gas duct, therefore, is not an additional component that is arranged on the catalyst chamber by means of a connection formed in some way, but rather the catalyst chamber and exhaust gas duct form an inseparable unit. It goes without saying that the exhaust gas duct can of course also be formed by both chamber halves. The exhaust gas duct can have arbitrary cross-sections.

Further advantageous developments of the exhaust gas system are described in sub-claims 2-18.

By means of the solution described above, it is possible for the exhaust gas duct to be formed into one or more chamber halves. This forming can take place for example by deep-drawing, countersunk-pressing, punching or other forming operation. Since the chamber halves of the catalyst chamber can comprise one sheet metal piece, the exhaust gas duct can be implemented simultaneously with the forming of the catalyst chamber. Consequently, no additional production step is required for the construction of the exhaust gas duct. It is also clear that the shape, i.e. the cross-section of the exhaust gas duct and the course of the exhaust gas duct, can easily be achieved through the forming process for the chamber half. Thus, for example, the exhaust gas duct can be designed curved and/or meandering, in order in this way to extend the length of the exhaust gas duct. Flame formation outside the exhaust gas system can be avoided by a sufficient length of the exhaust gas duct, even when the exhaust gas duct is led directly to the exterior or into the environment.

The catalyst chamber can be used in order to divide the interior space of the exhaust gas system or the external housing into at least two zones separated from one another. For this purpose, the catalyst chamber can be designed in terms of its two-dimensional extension in such a way that it fills or closes, for example, a complete cross-section through the exhaust gas system in terms of its two-dimensional extension. If necessary, at least one chamber half is provided circumferentially equal to the cross-section of the exhaust gas system. Both chamber halves can of course also have the same circumferential shape in order to close a cross-section through the exhaust gas system. As a result of this measure, the exhaust gas system is divided into at least two zones separated from one another, which can even be provided gas-tight with respect to one another.

A zone can be used as a sound damper, into which the unconverted exhaust gas first passes. This zone is provided close to the cylinder in the exhaust gas system. After the admitted exhaust gas has been conveyed through the catalyst chamber and the exhaust gas duct, it can pass into a further zone or can be conveyed directly to the environment. The further zone thus serves chiefly as heat protection against the converted exhaust gas. This zone can additionally be filled with insulating material such as for example insulating wool.

As already mentioned, the exhaust gas exit opening of the exhaust gas duct, which is arranged at the end of the duct facing away from the catalyst element, can end in the interior space of the exhaust gas system or directly at an exhaust gas outlet of the external housing. In order to achieve additional cooling of the external housing, ventilation openings can be provided in the external housing, in particular in the front shell, through which cold fresh air passes into the exhaust gas system. Here, it is certainly expedient for this fresh air to pass only in a closed-off zone of the exhaust gas system that is not filled with the unconverted exhaust gases. In order to increase the cooling effect, a nozzle, in particular a Venturi nozzle/injector nozzle, can also be provided at the exhaust gas exit opening of the exhaust gas duct. The effect of this is that the fresh air entering via the ventilation openings is entrained with the hot, converted exhaust gas as it exits. A cooling air stream is produced by the use of the Venturi nozzle, as a result of which not only the converted exhaust gas is cooled, but also a part of the external housing.

In a particular variant of the exhaust gas system according to the invention, the front shell of the external housing at the same time forms a part of the catalyst chamber. Consequently, the front shell of the external housing can with this variant be replaced by a chamber half of the catalyst chamber. With this variant, it is obvious that the exhaust gas exit opening of the exhaust gas duct leads directly to the exterior. Viewed overall, this variant of the exhaust gas system manages with very few components. Since, however, a partial area of the exhaust gas system becomes very hot, which in fact comes directly into contact with the converted exhaust gases, it is advisable to provide an additional heat shield against the hot area of the exhaust gas system. This heat shield can for example comprise an aluminium shell or sheet, in order to conduct away efficiently the heat that is present and thus to achieve an acceptable temperature level.

In order to achieve a high conversion rate in the cleaning of the exhaust gas, it is recommendable to design at least one catalyst element with a large area. If grid-type, perforated-plate-type or mesh-type catalyst elements are used, the latter can be arranged beside one another, in order thereby to achieve a greater stability with the arrangement of the catalyst elements beside one another. However, honeycomb-type catalyst elements could of course also be used. It is also conceivable to arrange at least two catalyst elements one behind the other in the flow direction of the exhaust gas. In this connection, one also speaks of a series connection of the catalyst elements. As has already been mentioned above, it is also possible to arrange two catalyst chambers one behind the other. An exhaust gas exit opening of the first exhaust gas duct can then end in the entry openings of the second catalyst chamber.

Moreover, it is also conceivable to arrange two or more catalyst chambers in parallel beside one another.

In order to arrange the catalyst element present such that it is fixed in the catalyst chamber, distance pieces are provided in at least one chamber half. These distance pieces can also be created by simple deforming of the chamber halves. The catalyst element can thus be held in the catalyst chamber in a keyed and/or friction-locked manner by means of the inserted distance pieces. If two catalyst elements are provided one behind the other in a catalyst chamber, the latter can be held at a prescribed spacing by means of an additional spacer frame. The spacer frame itself is made from sheet metal or suchlike, which is punched out inside, so that the frame scarcely causes a flow resistance between the catalyst elements. Further distance pieces can also be provided on the spacer frame in order to increase the sheet metal thickness of the frame and thus to enlarge the spacing between the catalyst elements.

In order to avoid heat-related harmful stresses, it is expedient to provide at least one connection element, by means of which the catalyst chamber or the halves of the catalyst chamber are held together. This connection element should preferably be arranged centrally in the area of the catalyst elements. The whole catalyst chamber and the internally arranged catalyst elements and any spacer frame or distance washers present are secured by this connection element. A reversibly detachable connection element can be used, as well as a nut/bolt connection for example. A rivet, a welding point or a torx connection can of course also be used as a connection element. In order to simplify the assembly of the catalyst chamber, the nut can be arranged fixed on a chamber half, for example by means of a weld joint or keyed connection.

In order that the structure of the exhaust gas system is further simplified, it is conceivable for the catalyst chamber to be clamped by its edge regions between the rear shell and the front shell of the external housing. The catalyst chamber can thus be held together solely by jointing together the front and rear shell. The catalyst chamber can also be held together by itself in its edge regions by means of flanging.

In order that better cooling of the catalyst chamber can be achieved, additional cooling surfaces can be provided on the catalyst chamber. These additional cooling surfaces can be designed particularly elegantly if the external housing of the exhaust gas system is at the same time to be divided into two zones by the catalyst chamber. Thus, additional surfaces can be provided in the two chamber halves on the left-hand and right-hand side beside the discharge duct, by means of which the separation of the external housing into two zones is brought about at the same time.

In order to increase the conversion rate of the catalyst element, it is advisable for a flow to pass through a catalyst element at right angles to the flow direction of the exhaust gas duct. By means of this measure, a large part of the exhaust gas flows repeatedly through the catalyst element arranged at right angles before it can pass into the exhaust gas duct. The exhaust gas system according to the invention obviously also functions with a catalyst element which is arranged in the same flow direction as the exhaust gas duct.

In order that the power of the combustion engine is not reduced by the exhaust gas system, it is recommended that a flow resistance as small as possible is built up in the exhaust gas system. For this purpose, a chamber half, which is arranged adjacent to the rear shell with an exhaust gas duct, can comprise at least one entry opening, through which the exhaust gas passes into the catalyst chamber. Alternatively, or in addition, there can be present in the other chamber half, which is arranged adjacent to the front shell, at least one exit opening through which the exhaust gases pass from the catalyst chamber directly or indirectly to the exterior. The exit opening is arranged in the front shell. Consequently, the exhaust gas flows more or less once at right angles through the exhaust gas system before it passes cleaned into the environment.

Figure 2:
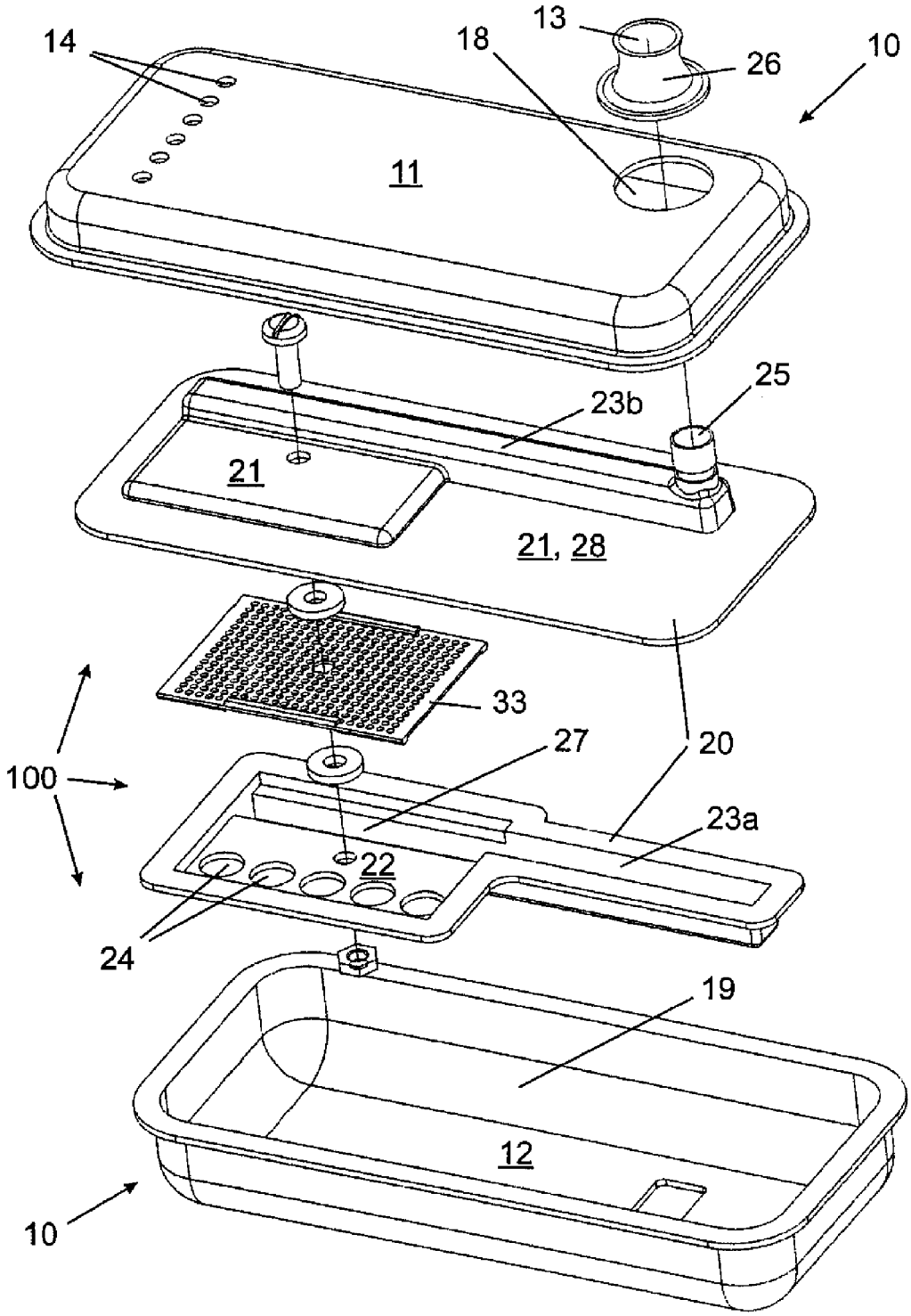
Figure 3:
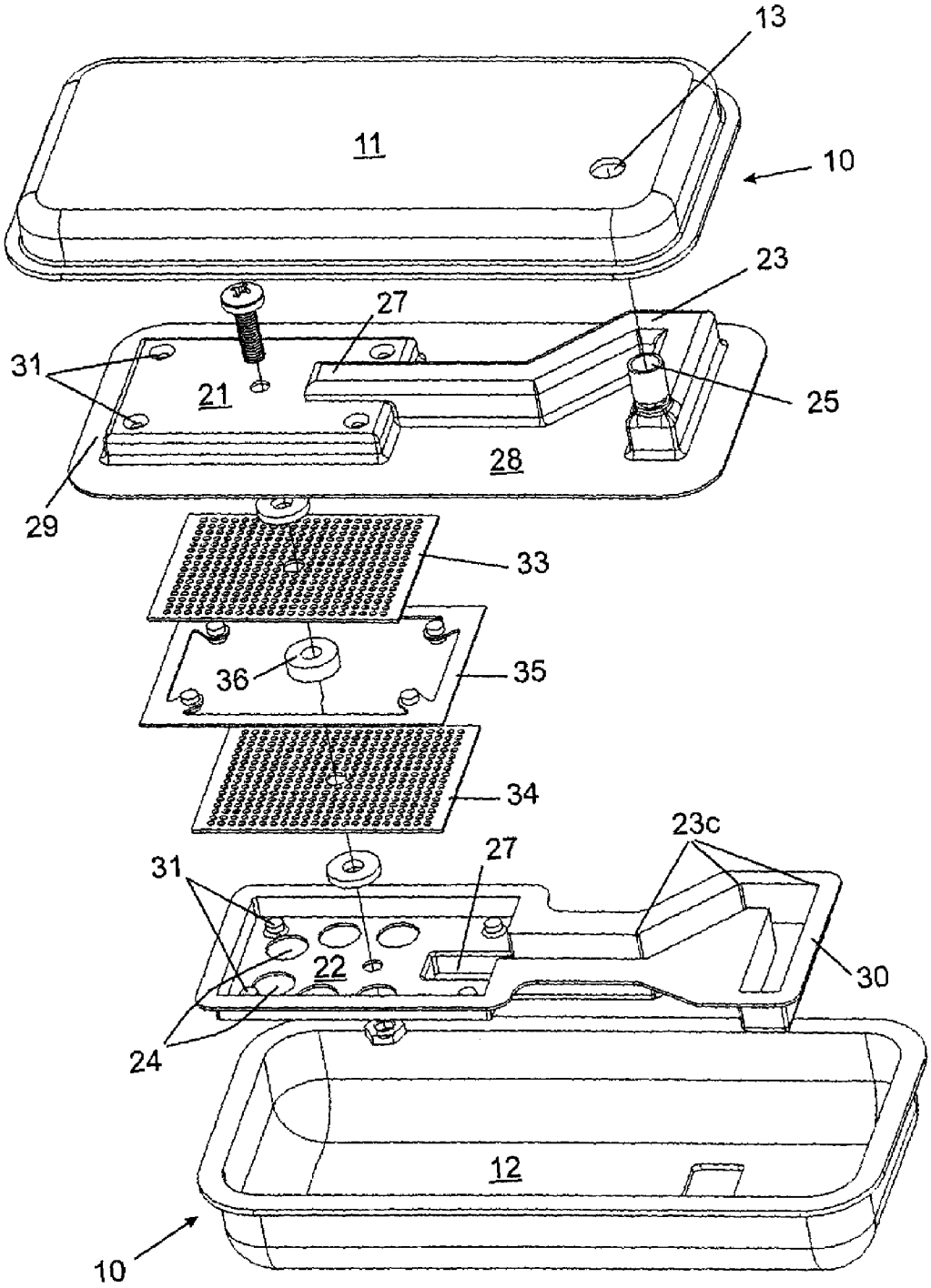

The invention is explained in greater detail below in various examples of embodiment with the aid of the appended drawings. In the figures, in merely diagrammatic representation, FIG. 1 shows, in a three-dimensional exploded view, and exhaust gas system according to the invention with a catalyst element and a linear exhaust gas duct as well as an insulating element, FIG. 2 shows, in a three-dimensional exploded view, a similar exhaust gas system according to the invention—as in FIG. 1—with additional ventilation openings in the front shell and an injector, and FIG. 3 shows, in a three-dimensional exploded view, a further exhaust gas system according to the invention with two catalyst elements and a meandering exhaust gas duct.

A first variant of exhaust gas system 100 according to the invention is shown in FIG. 1. External housing 10 of exhaust gas system 100 is essentially right-parallelepiped shaped. In the present case, the latter comprises a front shell 11 and a rear shell 12, the invention not being restricted to a two-part housing 10. An exhaust gas inlet 16 for the entering exhaust gas from the combustion engine is provided in rear shell 12. Since the opening area of rear shell 12 and front shell 11 is closed by catalyst chamber 20 which is present, a first zone 18 arises in front shell 11 and a second zone 19 in rear shell 12, whereby the two zones 18, 19 are separated from one another in a gas-tight fashion. The entered exhaust gas from second zone 19 therefore has to enter into catalyst chamber 20 through five circular entry openings 24. Entry openings 24 are provided for this purpose in second chamber half 22. Once the exhaust gas has passed into catalyst chamber 20, it is guided through a catalyst element 33. Actual catalyst chamber 20 is designed right-parallelepiped shaped, in order that rectangular catalyst element 33 can be arranged in a space-saving manner. The right-parallelepiped-shaped cutouts of catalyst chamber 20 are formed into two chamber halves 21 and 22 by a deformation process. After the exhaust gas has been converted in catalyst element 33, it can now pass into exhaust gas duct 23. The latter is incorporated linearly in first and second chamber halves 21, 22, as is the actual catalyst chamber also. Exhaust gas duct 23 extends over the whole width or length of catalyst element 33. An opening 27 of exhaust gas duct 23 on the catalyst side thus begins roughly flush left with catalyst element 33.

In order to position catalyst element 33 fixed in catalyst chamber 20 in a straightforward manner, two distance washers 36 are provided, which are provided between first chamber half 21 and catalyst element 33 and also between catalyst element 33 and second chamber half 22. The two chamber halves 21, 22 of catalyst chamber 20 are secured, or held together, by connection element 32, which is guided through the two distance washers 36. The reversibly detachable connection element 32 is designed in the present case in two parts and comprises for example a nut and a bolt.

The converted exhaust gas passes from exhaust gas duct 23 through exit opening 25. The latter can end inside external housing 10 beneath front shell 11. It is also conceivable for exit opening 25 to be embodied by an exhaust gas outlet 13 in front shell 11, so that the exhaust gas passes directly to the exterior. In order that front shell 11 does not become heated unnecessarily, an additional insulating element 37 is provided between catalyst chamber 20 or first chamber half 21 and front shell 11. This insulating element 37 can comprise for example a cushion made of glass fibres.

FIG. 2 discloses a similar embodiment to inventive exhaust gas system 100 from FIG. 1. Rear shell 12 and catalyst chamber 20 are provided with the same design. Only exit opening 25 of exhaust gas duct 23 and front shell 11 exhibit structural changes compared with exhaust gas system 100 from FIG. 1. In FIG. 2, exit opening 25 is constituted open, an annular gap being provided through which gases from first zone 18 are entrained with the exiting exhaust gas flow. In addition, an injector 26 or a nozzle 26, in particular a Venturi nozzle, is for example used at exhaust gas outlet 13, by means of which a cooling flow is produced in first zone 18 under front shell 11. For this purpose, there are provided in front shell 11 additional ventilation openings 14, through which fresh air can penetrate into exhaust gas system 100. This fresh air is drawn by the generated suction during the exit of the exhaust gas under front shell 11. Cooling of front shell 11 takes place through this forced convection. At the same time, the hot converted exhaust gases are mixed with the sucked-in fresh air as it exits from injector 26, as a result of which cooling of the exhaust gas also takes place. Smaller exit opening 25 can project into injector 26 or nozzle 26 in the variant of embodiment of exhaust gas system 100 from FIG. 2.

In FIG. 3, external housing 10 is constructed with the same design as exhaust gas system 100 from FIG. 1, but a differently designed catalyst chamber 20 is used. Moreover, two catalyst elements 33 and 34 are used, which are arranged inside catalyst chamber 20. In order to create a certain minimum spacing between perforated-plate-type catalyst elements 33, 34, use is made of a spacer frame 35. This spacer frame 35 essentially comprises a rectangular metal sheet, additional distance pieces being provided in the corner areas in order to enlarge the spacing between catalyst elements 33, 34. Spacer frame 35 is punched out in the middle, so that the exhaust gases can pass without flow resistance from first catalyst element 33 to second catalyst element 34. In addition, distance washers 35 can be inserted between the catalyst elements and chamber halves 21, 22. In the present variant of embodiment, a total of six large-area entry openings 24 are provided in first chamber half 21, through which the as yet unconverted exhaust gas enters into catalyst chamber 20. In order that catalyst elements 33, 34 do not rest over a large area directly against chamber halves 21, 22, additional distance pieces 31 are formed into chamber halves 21, 22. This forming can take place for example by punching or pressing or deep-drawing. Exhaust gas duct 23 following on from catalyst chamber 20 is designed meandering. This exhaust gas duct 23 is formed into first chamber halve 21 and second chamber half 22. It would also be sufficient for exhaust gas duct 23 to be formed solely into chamber half 21 or 22.

In order, on the one hand, to separate first zone 18 from second zone 19 of the interior space of exhaust gas system 100, first chamber half 21 is designed with a larger area, so that the complete cross-section of external housing 10 is thereby covered. At the same time, the surfaces to the left and right of exhaust gas duct 23 serve as cooling surfaces 28, as a result of which additional heat of exhaust gas duct 23 can be carried away. In order to save as much material is possible, these cooling areas 28 can be dispensed with in the case of second chamber half 22. Cooling areas 28 can of course also be provided solely on second chamber half 22. Moreover, the external housing remains at a low temperature level due to the all-round spacing from the duct and the chamber.

In order to seal both chamber halves 21, 22 in a gas-tight manner, the two chamber halves 21, 22 are secured by a connection element 32. As a result of the single-point fixing, the catalyst element does not tend to bulge when it expands due to heating. This connection element 32 again comprises a nut and a bolt. However, a rivet connection or suchlike can also be used. Moreover, the two chamber halves 21, 22 can also be held together solely in their edge regions 29, 30. This can take place for example by clamping of the chamber halves between front shell 11 and rear shell 12. The two chamber halves 21, 22 can also be welded or soldered.

As already described, exhaust gas duct 23 is designed meandering in FIG. 3 and resembles a figure "7". Opening 27 on the catalyst side is not arranged over the whole width of catalyst elements 33, 34, but overlaps only over a small part. The converted exhaust gas must pass through this opening 27 into exhaust gas duct 23, in order then to be conveyed through the various curves and bends 23*c* in exhaust gas duct 23. The length of exhaust gas duct 23 can be extended by these bends and curves 23*c*. A flame formation outside exhaust gas system 100 can be avoided by this means.

Finally, it should be mentioned that the previously described technical features can be used alone or in combination in exhaust gas system 100 according to the invention, inasmuch as they do not mutually exclude one another. Exhaust gas system 100 can also be used as an initial, middle or final position for a partially existing exhaust gas system.

The invention claimed is:

1. An exhaust gas system (100) for a combustion engine with at least one external housing (10), which contains at least one rear shell (12) and one front shell (11), and with a catalyst chamber (20), in which at least one catalyst element (33, 34) is arranged, and with an exhaust gas duct (23), from which exhaust gas is conveyed from the catalyst chamber (20), characterised in that an interior space of the external housing (10) is divided by the catalyst chamber (20) into at least two gas-tight zones (18, 19) separated from and not in fluid communication with one another, the catalyst chamber (20) also forms the exhaust gas duct (23), the catalyst chamber (20) comprising at least two chamber halves (21, 22), and the exhaust gas duct (23) being provided materially uniform and in one piece in at least one chamber half (21, 22).

2. The exhaust gas system according to claim 1, characterised in that the exhaust gas duct (23) is formed in at least one chamber half (21, 22).

3. The exhaust gas system according to claim 1, characterised in that an exhaust gas exit opening (25) of the exhaust gas duct (23), which is arranged at the end of the exhaust gas duct (23) facing away from a catalyst element (33, 34), is provided at an exhaust gas outlet (13) of the external housing (10).

4. The exhaust gas system according to claim 1, characterised in that there are provided in the front shell (11) ventilation openings (14), through which fresh air passes into the exhaust gas system (100).

5. The exhaust gas system according to claim 3, characterised in that the exhaust gases exit opening (25) of the exhaust gas duct (23) has a Venturi nozzle (26) or an injector pump.

6. The exhaust gas system according to claim 1, characterised in that the front shell (11) of the external housing (10) forms a part of the catalyst chamber (20).

7. The exhaust gas system according to claim 1, characterised in that the exhaust gas duct (23) is designed curved and/or meandering.

8. The exhaust gas system according to claim 1, characterised in that at least one of the catalyst elements (33, 34) is designed with a large area.

9. The exhaust gas system according to claim 1, characterised in that at least two catalyst elements (33, 34) are arranged one behind the other in the flow direction of an exhaust gas.

10. The exhaust gas system according to claim 1, characterised in that at least one of the catalyst elements (33, 34) is arranged fixed in the catalyst chamber (20) by means of distance pieces (31), which are formed in at least one chamber half (21, 22).

11. The exhaust gas system according to claim 1, characterised in that a spacer frame (35) is arranged between two catalyst elements (33, 34) in order to produce a spacing between the two catalyst elements (33, 34).

12. The exhaust gas system according to claim 1, characterised in that the catalyst chamber (20) is held together by means of at least one connection element (32).

13. The exhaust gas system according to claim 12, characterised in that the elements present in the catalyst chamber (20) are positioned fixed and at least largely stress-free by means of the connection element (32).

14. The exhaust gas system according to claim 1, characterised in that the catalyst chamber (20) is held together by means of flanging in an edge region (29, 30) of the chamber halves (21, 22).

15. The exhaust gas system according to claim 1, characterised in that the catalyst chamber (20) has additional cooling surfaces (28) and therefore has an all-round spacing from the external housing.

16. The exhaust gas system according to claim 1, characterised in that a flow passes through the at least one catalyst element (33, 34) at right angles to a flow direction of the exhaust gas duct (23).

17. The exhaust gas system according to claim 1, characterised in that there is provided in one chamber half (21, 22), which is arranged adjacent to the rear shell (12) with an exhaust gas inlet (16), at least one entry opening (24) through which the exhaust gas passes into the catalyst chamber (20), and that there is present, in another chamber half (21, 22) which is arranged adjacent to the front shell (11), at least one exit opening (25), which lies in the region of the exhaust gas outlet (13) of the front shell (11), through which exit opening the exhaust gases pass from the catalyst chamber (20) directly or indirectly to the exterior.

18. An exhaust gas system (100) for a combustion engine with at least one external housing (10), which contains at least one rear shell (12) and one front shell (11), and with a catalyst chamber (20), in which at least one catalyst element (33, 34) is arranged, and with an exhaust gas duct (23), from which exhaust gas is conveyed from the catalyst chamber (20), characterised in that an interior space of the external housing (10) is divided by the catalyst chamber (20) into at least two gas-tight zones (18, 19) separated from and not in fluid communication with one another, and the catalyst chamber (20) forms the exhaust gas duct (23), the catalyst chamber (20) comprising at least two chamber halves (21, 22), the exhaust gas duct (23) being provided materially uniform and in one piece in at least one chamber half (21, 22), and at least one of the catalyst elements (33, 34) is arranged fixed in the catalyst chamber (20) by means of distance pieces (31), which are formed in at least one chamber half (21, 22).

19. An exhaust gas system (100) for a combustion engine with at least one external housing (10), which contains at least one rear shell (12) and one front shell (11), and with a catalyst chamber (20), in which at least one catalyst element (33, 34) is arranged, and with an exhaust gas duct (23), from which exhaust gas is conveyed from the catalyst chamber (20), characterised in that an interior space of the external housing (10) is divided by the catalyst chamber (20) into at least two gas-tight zones (18, 19) separated from and not in fluid communication with one another, and the catalyst chamber (20) forms the exhaust gas duct (23), the catalyst chamber (20) comprising at least two chamber halves (21, 22) held together by means of at least one connection element (32), the exhaust gas duct (23) being provided materially uniform and in one piece in at least one chamber half (21, 22), and elements present in the catalyst chamber (20) are positioned fixed and at least largely stress-free by means of the connection element (32).

* * * * *